US006064344A

United States Patent [19]

Walton

[11] Patent Number: 6,064,344

[45] Date of Patent: May 16, 2000

[54] REMOVAL OF WATER ON A SATELLITE COVER USING PRESSURIZED AIR

[76] Inventor: William B. Walton, 5607 Ave. Juan Bautista, Riverside, Calif. 92509

[21] Appl. No.: 09/042,604

[22] Filed: Mar. 16, 1998

Related U.S. Application Data

[63] Continuation-in-part of application No. 08/680,777, Jul. 16, 1996, Pat. No. 5,729,238, which is a continuation-in-part of application No. 08/530,588, Sep. 19, 1995, Pat. No. 5,798,735.

[51] Int. Cl.[7] ..... H01Q 1/02

[52] U.S. Cl. ..... 343/704; 343/872; 392/422

[58] Field of Search ..... 343/704, 872, 343/912; 392/422, 420, 407; H01Q 1/02

[56] References Cited

U.S. PATENT DOCUMENTS

| | | | |
|---|---|---|---|
| D. 268,343 | 3/1983 | Mann et al. | D14/90 |
| D. 304,454 | 11/1989 | Serres | D14/230 |
| D. 305,334 | 1/1990 | Marr | D14/230 |
| 4,126,864 | 11/1978 | Hopkins | 343/704 |
| 4,213,029 | 7/1980 | Endicott, Jr. et al. | 219/209 |
| 4,259,671 | 3/1981 | Levin | 343/704 |
| 4,368,471 | 1/1983 | Walton, Jr. | 343/704 |
| 4,479,131 | 10/1984 | Rogers et al. | 343/872 |
| 4,536,765 | 8/1985 | Kaminski | 343/704 |
| 4,581,615 | 4/1986 | Levy | 343/755 |
| 4,804,972 | 2/1989 | Schudel | 343/840 |
| 4,866,452 | 9/1989 | Barma et al. | 343/704 |
| 4,918,459 | 4/1990 | De Teso | 343/872 |
| 4,955,129 | 9/1990 | McCauley et al. | 29/611 |
| 4,972,197 | 11/1990 | McCauley et al. | 343/704 |
| 5,010,350 | 4/1991 | Lipkin et al. | 343/704 |
| 5,353,037 | 10/1994 | Jones | 343/704 |
| 5,368,924 | 11/1994 | Merrill, Jr. et al. | 428/241 |
| 5,451,972 | 9/1995 | Franklin | 343/872 |
| 5,729,238 | 3/1998 | Walton, Jr. | 343/704 |
| 5,798,735 | 8/1998 | Walton, Jr. | 343/704 |

FOREIGN PATENT DOCUMENTS

| | | |
|---|---|---|
| 57-65033 | 4/1982 | Japan . |
| 58-151702 | 9/1983 | Japan . |
| 59-207701 | 11/1984 | Japan . |
| 2-34004 | 2/1990 | Japan . |
| 2-109402 | 4/1990 | Japan . |
| 2-109404 | 4/1990 | Japan . |

*Primary Examiner*—Hoanganh Le
*Attorney, Agent, or Firm*—Knobbe, Martens, Olson & Bear, LLP

[57] ABSTRACT

A system for preventing the interruption of satellite communications between an earth antenna and a satellite during inclement weather. The system is comprised of a cover that is adapted to be positioned on the opening of the satellite cover so as to reduce the likelihood of liquid water accumulating on the front reflecting surface of the antenna. The cover and the front reflecting surface further define a space and an air circulation system circulates air in the space. The circulating air increases the air pressure in the space relative to the surrounding atmosphere and pressurized air then travels through the cover and blows water accumulating on the outer surface of the cover off of the outer surface to further reduce the likelihood that accumulations of water on the outer surface of the cover will result in interruptions to satellite communications with the earth based satellite antenna.

14 Claims, 7 Drawing Sheets

REMOVAL OF WATER ON A SATELLITE COVER USING PRESSURIZED AIR

RELATED APPLICATIONS

The present application is a continuation-in-part of application U.S. Ser. No. 08/680,777, filed Jul. 16, 1996 now U.S. Pat. No. 5,729,238, which is a continuation-in-part of application, U.S. Ser. No. 08/530,588 filed Sep. 19, 1995, now U.S. Pat. No. 5,798,735, entitled "HOT AIR DE-ICING OF SATELLITE ANTENNA WITH COVER."

BACKGROUND OF THE INVENTION

1. Field of the Invention

The present invention relates to satellite antennas and, in particular, concerns a system for removing excess water on a cover on the front face of an earth based satellite antenna so as to reduce accumulation of beaded water on the cover which can interfere with satellite communications.

2. Description of the Related Art

Satellite communication systems are becoming increasingly popular in today's world. For example, satellite communication systems are being used by networks of stores for providing inventory information between stores and these systems are also used for credit transactions. In particular, satellite communication systems have increasingly been used by retail stores to approve credit card transactions by individual customers. The primary advantage of satellite communications is that the information can be transmitted to a satellite and then returned to a distant ground station much quicker than the information can be transferred via the telephone lines.

The increasing use of satellite communications has resulted in the installation of many satellite dish antennas in colder or wetter climates. One particular problem with positioning satellite dish antennas in colder or wetter climates is that rain, snow or freezing rain can accumulate in the dish of the antenna. The accumulations of rain, snow or ice in the dish of the antenna can further result in an interruption of signals between that particular satellite antenna and the satellite. It will be appreciated that satellite networks in these climates are particularly vulnerable to interruption of the transfer of information on these systems during snow storms, rain storms and the like.

Several features have been developed in the past to address the problem of accumulations of water, snow and ice in satellite dish antennas. Satellite antennas have been equipped with fabric covers to prevent water, snow and ice from accumulating inside of the dish of the antenna. These covers are preferably made of a material that does not interfere with the signals travelling between the satellite and the antenna. One difficulty with these covers, however, is that, while these covers are generally successful in keeping water, snow and water from accumulating inside of the dish, these covers will quite often be coated by water, snow or frozen water in certain conditions.

For example, when there is a wet snow, the wet snow has a tendency to stick to the outside cover of the satellite dish. Similarly, when weather conditions are producing sleet or freezing fog, the frozen ice can also accumulate on the outside cover of the antenna. Even in a rainstorm, or in high humidity, water can bead up on the outer cover of the antenna and can significantly affect communications between the satellite and the earth-based antenna. This is a problem particularly in humid climates where the amount of moisture in the air may result in water accumulating on the outer cover of the antenna in quantities sufficient to interrupt communications even when there is no rainstorm.

Consequently, while covers provide some protection against the interruption of communications resulting from water, snow or ice accumulating on the antenna dish, the outer surface of the covers themselves can become covered with water or frozen precipitation that can result in the interruption of satellite communications. While systems have been used in the prior art that heat the antenna, these systems have not always been effective in preventing the interruption of communications and they are particularly poorly suited for preventing the interruption of communications resulting from the accumulation of water, in the form of either rain or condensation, from accumulating on the outer surface of the cover and interrupting communications.

Hence, there is a need for a system that is capable of reducing the likelihood that the accumulations of water will interrupt satellite communications. There is a particular need for a system that is capable of reducing the likelihood that condensation or rain water will interrupt satellite communications as a result of the moisture accumulating on the outer surface of a cover positioned on the front face of an earth based satellite antenna.

SUMMARY OF THE INVENTION

The aforementioned needs are satisfied by the water removal system for earth based satellite antennas of the present invention that is comprised of a cover that is adapted to be positioned over the front opening of an antenna and an air circulation system that is adapted to circulate air through the space between the front surface of the antenna and the inner side of the front cover. Preferably, the front cover is made of a material that allows air to travel through so that the air provided into the space between the front cover and the front surface of the antenna travels through the cover and displaces at least some of the water accumulated on the outer cover off of the outer cover of the antenna.

In one aspect of the present invention, a breathable cloth is used to form the cover. The air circulation system circulates the air between the cover and the reflector thereby pressurizes this space. The pressurized air in the space is then forced through intersticial openings in the cover that are too small to allow a significant quantity of beaded or sheeted water to travel into the space. The air, upon exiting the space through the openings in the cover blows water off of the outer surface of the cover thereby reducing the accumulations of beaded or sheeted water on the outer surface of the cover.

In one embodiment, the system includes a moisture detector that detects the presence of moisture. The system includes a controller that is configured to turn on a blower when the presence of moisture is detected. The blower then increases the air pressure in the space between the inner surface of the cover and the front reflecting surface of the antenna by blowing air at approximately 40 to 60 CFM into the space which causes the pressurized air from the space to travel through the cover and blow off liquid water that has accumulated on the front surface of the cover.

The present invention therefore reduces the likelihood that the accumulation of water on the front surface of the antenna cover will interrupt satellite communications by removing at least a portion of this water. It will be appreciated that the system can be combined with heating systems so that the integrated system is capable of both reducing the accumulations of snow and ice on the cover as well as reducing the accumulations of moisture from rain or condensation on the front surface of the cover. These and other objects and advantages of the present invention will become more apparent from the following description taken in conjunction with the accompanying description.

DETAILED DESCRIPTION OF THE PREFERRED EMBODIMENT

Figure 1:
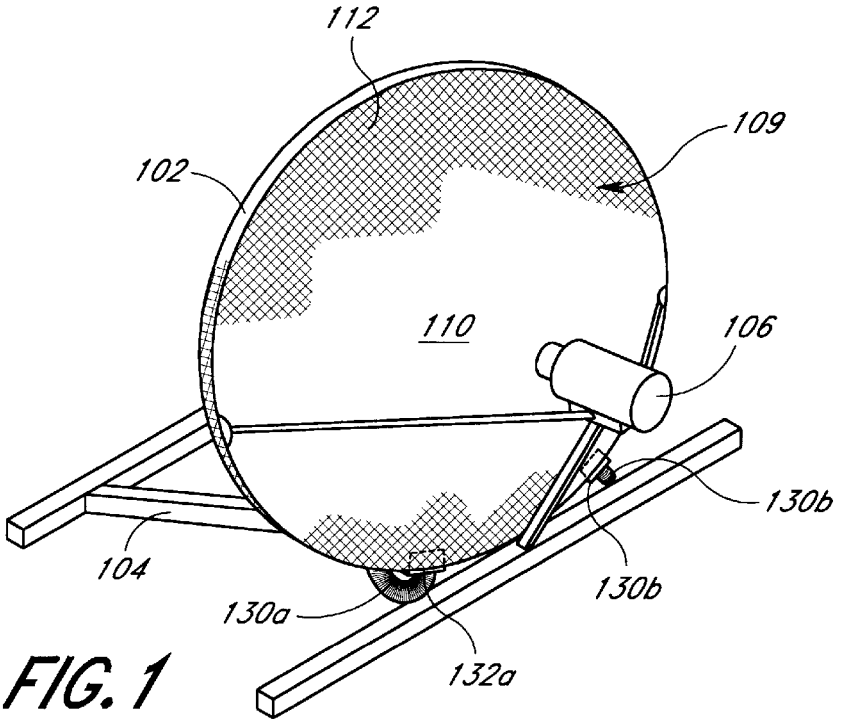
FIG. 1 is a front perspective view of a typical satellite communications antenna equipped with the heating system of the preferred embodiment.

Reference will now be made to the drawings wherein like numerals refer to like parts throughout. Referring now to FIG. 1, an earth satellite antenna 100 is illustrated which is generally comprised of an antenna dish 102 that is mounted on a frame 104 and a collector 106 that is positioned in front of a front side 109 of the antenna dish 102 so as to collect signals reflected from a reflecting surface 110 of the dish 102. In the embodiment shown in FIG. 1, the front side 109 of the antenna dish 102 is generally circular in shape and has a concave configuration. Specifically, the antenna dish 102 is concave so that any signal impinging upon the reflecting surfaces 110 is reflected towards the collector 106.

In the embodiment shown in FIG. 1, a cover 112 is also mounted on the front side 109 of the antenna dish 102. The cover 112 is preferably stretched taut over the concave opening of the antenna dish 102 so as to prevent snow and other precipitation from accumulating on the reflecting surfaces 110 on the inside of the dish 102. In the preferred embodiment, the cover is made of a flexible, breathable material, preferably a polyester material or Teflon cloth, such as the cloth sold under the Gortex trademark. It will be appreciated that the cover 112 should preferably be made of some water resistant material that does not inhibit the transmission of satellite communications signals to and from the antenna dish 102. In the preferred embodiment, the cloth comprising the cover 112 is comprised of a non-laminated polyester material such as teflon cloth. Preferably, the material is not laminated so that the cloth is breathable, i.e., will allow air but not water to travel therethrough as will be discussed in greater detail below.

Figure 2:
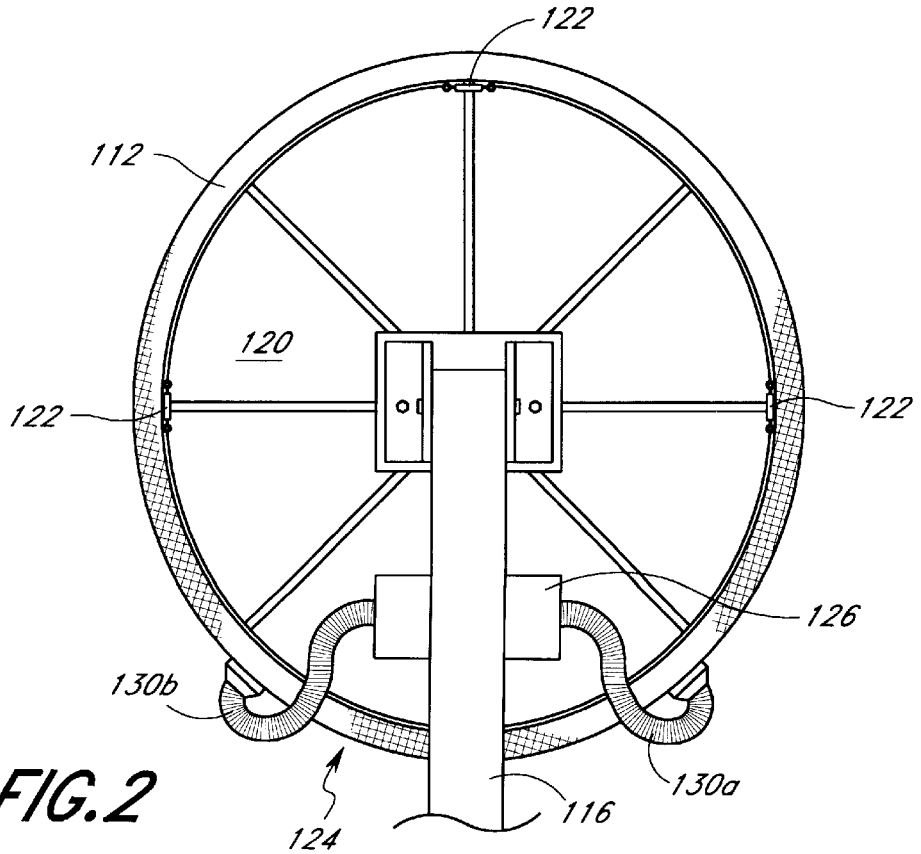
FIG. 2 is a rear perspective view of the antenna shown in FIG. 1 with the heating system of the preferred embodiment installed thereon.

FIG. 2 illustrates a back side 114 of the satellite antenna 100 in greater detail. In particular, the earth satellite antenna 100 is mounted on a vertical support 116 in a well-known manner that permits the antenna dish 102 to be oriented in a desired vertical and horizontal orientation and then fixed in the desired orientation. Further, in this embodiment, the antenna dish 102 is constructed of a number of segments 120 of a desired shape. As is also shown in FIG. 2, the cover 112 is stretched completely over the opening in the front side 109 of the antenna dish 102 and extends onto the back side 114 wherein a spring cable and turnbuckle assembly 122 securely retains the cover 112 on the antenna dish 102 in a well-known manner. It will, however, be appreciated that any number of methods can be used to secure the cover on the antenna dish 102, including positioning elastic material at the outer periphery of the cover 112, that would retain the cover 112 on the antenna dish 102 so as to substantially cover the front side 109 of the antenna dish 102 without departing from the present invention.

It will be appreciated that since the antenna dish 102 in the preferred embodiment is concave, positioning the cover 112 so as to be taut across the front face 109 of the antenna dish 102 results in a space 111 being defined between the reflecting surfaces 110 of the antenna dish 102 and the cover 112. This space is further illustrated in FIGS. 3C and 3D. As will be described in greater detail hereinbelow, in one embodiment, the air heating system 124 provides heated air into the space 111 so as to preferably maintain the cover 112 at a temperature that will prevent snow and ice from forming on the outside surface of the cover and interrupting communications between the antenna assembly 100 and a satellite. It will be appreciated that providing the heated air directly into the space 111 results in the antenna dish 102 being heated. This reduces the accumulations of snow and ice on the back side of the antenna dish 102 which thereby reduces the possibility of damage to the antenna dish 102 as a result of the accumulations of snow and ice. Specifically, if too much snow and ice accumulate on the backside of the dish 102, the dish can collapse or "clamshell". Heating the space 111 reduces this possibility as the dish 102 can preferably be heated to a temperature sufficient to prevent excess accumulations of snow and ice on the backside of the dish 102.

FIG. 2 also illustrates that the air and heating system 124 is mounted on the vertical support 116 of the antenna 100. In particular, the heating system 124 includes an enclosure 126 that contains components of the heating system 124, that will be described in greater detail hereinbelow, and two tubes 130*a* and 130*b* which are respectively a heat inlet tube 130*a* and a heat outlet tube 130*b*. As shown in FIG. 1, the tubes 130*a* and 130*b* are positioned within openings 132*a* and 132*b* respectively in the cover 112 on the front side of the antenna dish 102. As will be described in greater detail hereinbelow, the air and heating system 124 provides heated air into the space 111 between the cover 112 and the reflecting surface 110 of the antenna dish 102 so as to maintain the cover 112 at a temperature sufficient to prevent the accumulation of snow and ice on the cover 112. While in the embodiment shown in FIG. 2 the air and heating assembly 124, and in particular the enclosure 126, is shown as mounted on the vertical support 116 of the antenna 100, it will be appreciated that the enclosure 126 can be mounted in any of a number of locations on or adjacent to the antenna 100 without departing from the spirit of the present invention.

Figure 3A:
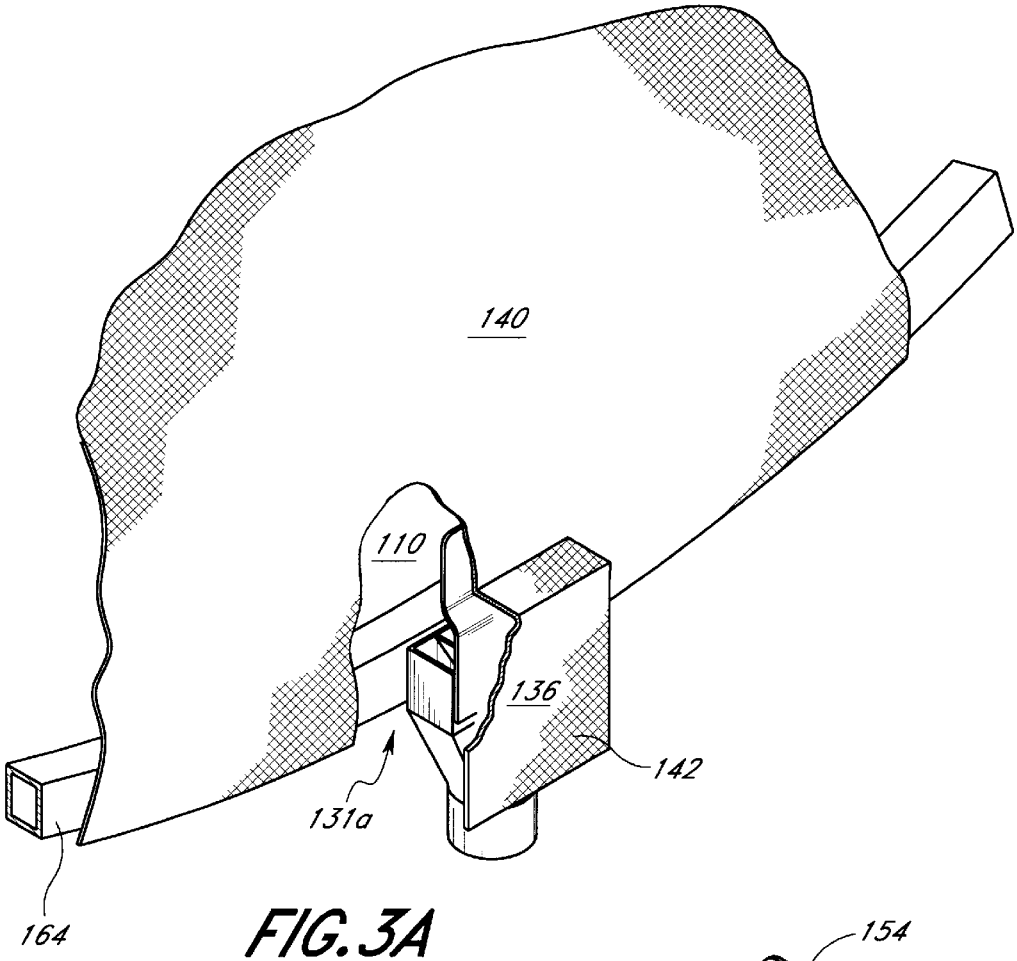
FIG. 3A is a detailed perspective view of an intake fitting which provides heated air to the space between the cover and the antenna.

Referring now to FIG. 3A, the inlet opening 132*a* in the cover 112 is illustrated in greater detail. The following description in reference to FIGS. 3A–3D describes the inlet opening 132*a* and an associated inlet fitting 134*a*, however, the outlet opening 132*b* and an outlet fitting 134*b* are nearly identical in construction. Specifically, in the preferred embodiment the cover 112 is configured to have a generally rectangular pouch 136 that extends outward from a main portion 140 of the cover 112 so as to define the opening 132*a*. The rectangular pouch 136 has a flap 142 that on the underside has an attaching surface such as a hook and loop material. As shown in FIG. 3A, there is an inlet fitting 134*a* that is configured to be connected to the inlet tube 130*a* that is positioned in the pouch 136 so that the inlet fitting 134*a* extends into the opening 132*a* in the cover 112.

Figure 3B:
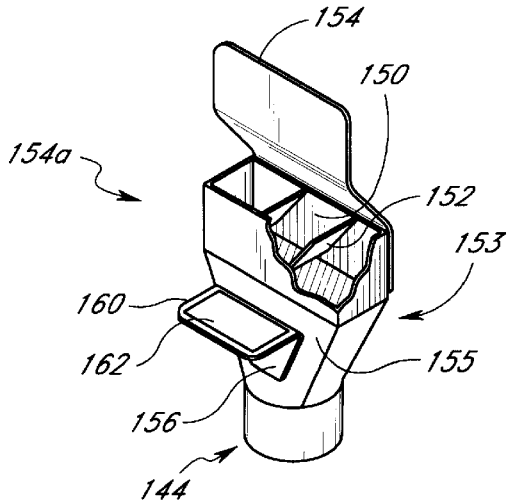
FIG. 3B is a detailed perspective view of the intake fitting shown in FIG. 3A.

The inlet fitting 134*a* is illustrated in greater detail in FIG. 3B. In particular, the inlet fitting 134*a* has a hollow circular section 144 that is open at one end that is configured to receive the inlet tube 130*a* in the manner shown in FIG. 2. Specifically, the inlet tube 130*a* is positioned over the circular section 144 in the inlet fitting 134*a*. The circular section 144 is then connected to a generally rectangular hollow section 146 that has a rectangular opening 150 at the end opposite the circular section 144. The rectangular section 146 has two directing vanes 152 adjacent the opening 150 that direct air, emanating from the inlet fitting 144, in a generally clockwise direction in the space 111 in the manner that will be described hereinbelow in conjunction with FIG. 5. Further, there is a flange 154 positioned on a top side 153 of the inlet fitting 134*a* that is configured to ensure that the cover 112 is not blocking the rectangular opening 150 and preventing heat from passing from the inlet fitting 134 into the space 111.

Figure 3C:
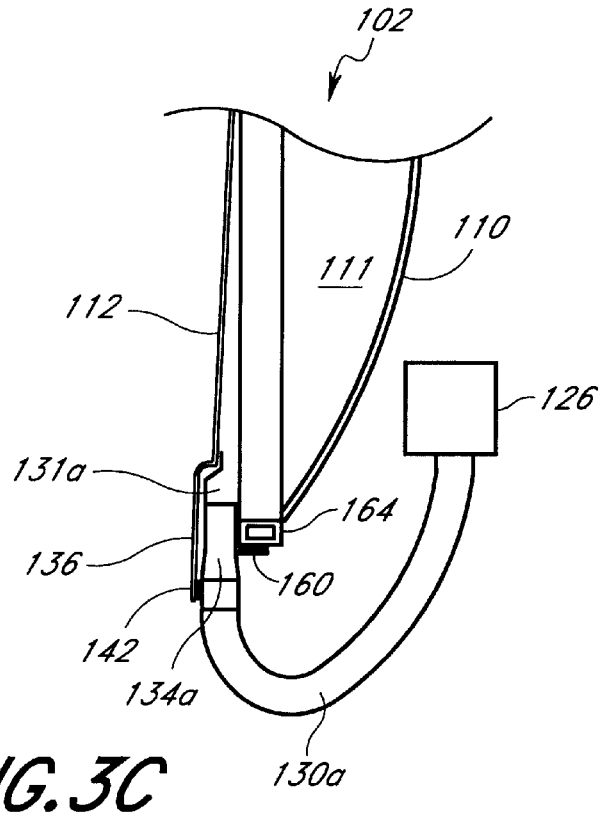
FIG. 3C is a sectional view of the cover and the satellite antenna having the system of FIG. 1 installed thereon further illustrating the mounting of the intake fitting and the cover.

Further, as illustrated in FIG. 3B, on a bottom side 155 of the inlet fitting 134*a* there is a mounting flange 156 positioned thereon. The mounting flange 156 is a generally L-shaped piece of material having a mounting plate 160 that extends in a direction generally perpendicular to the bottom side 155 of the inlet fitting 134*a*. Preferably, the mounting plate 160 has a piece of hook and loop material 162, e.g., Velcro material, positioned thereon. As illustrated in FIG. 3C, the mounting plate 160 is positioned adjacent an outer rim 164 of the antenna dish 102 when the inlet fitting 134*a* is positioned in the opening 130*a*. Preferably, a matching piece of hook and loop material is positioned on an outer rim 164 of the antenna dish 102 so that the material 161 on the mounting plate 160 engages with the material on the outer rim 164 of the antenna dish 102 to securely maintain the inlet fitting 134 in the opening 130 in the cover 112.

Further, as is also shown in FIG. 3C, hook and loop material is also mounted on the underside of the flap 142 of the pouch 132*a* and on the top surface 153 of the fitting so that the flap 142 is securely attached to the upper surface 153 of the fitting 134*a* to further maintain the fitting 134*a* in the desired orientation shown in FIG. 3A. Hence, the fitting is positioned within the pouch 132*a* so that the rectangular opening 150 allows for air to be introduced through the opening 130*a* in the cover 112 and the fitting 134*a* is retained in this position by the detachable engagement between the hook and loop material on the mounting plate 160 and the upper surface 153 of the fitting 134*a*. It will be appreciated, however, that alternative forms of securing the fitting 134*a* to the rim 164 of the antenna dish 102 and to the flap 142 of the pouch 136 can be used without departing from the present invention. For example, snaps, glue and other types of securing means can be used.

Figure 3D:
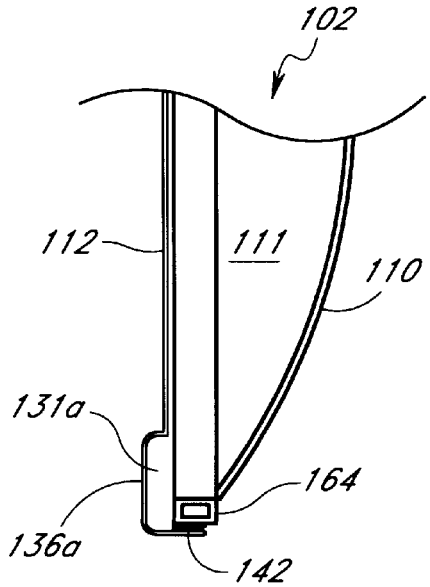
FIG. 3D is a sectional view of the cover and the satellite antenna of FIG. 3C, wherein the intake fitting has been removed and the cover has been secured to the antenna frame.

FIG. 3D illustrates that the cover 112 is configured so that when the air and heating system 124 of the present invention is not being used, the bottom side of the flap 142 can engage with the rim of the antenna 164 to close the cover 112 about the antenna dish 102. Hence, the cover 112 can be used in conjunction with the air and heating system 124 for dynamically providing air to and for heating the space 111 between the cover 112 and the reflecting surface 110 of the antenna dish 102 or the cover 112 can be installed on the antenna dish 102 to passively prevent the accumulation of snow and ice and other moisture on the concave reflecting surfaces 110 of the antenna dish 102.

Figure 4:
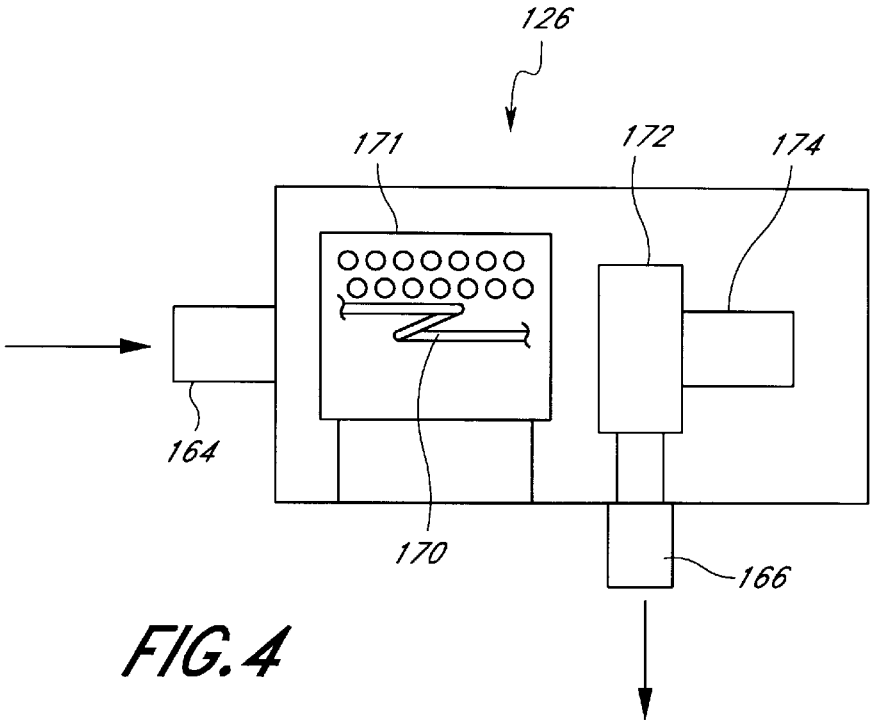
FIG. 4 is a detail of the heater/blower assembly which is a component of the heating system of the preferred embodiment.

FIG. 4 schematically illustrates the enclosure 126 which forms a portion of air circulation and the heating system 124. The heater enclosure 126 is preferably a rectangular box that has a heating element 170 and a blower 172 with an associated blower motor 174 positioned therein. The heating element 170 is positioned within the heater enclosure 126 so that an air intake opening 164 in the enclosure provides air directly to the heating element 170. As shown in FIG. 4, the heating element 170 is positioned so as to located inside of a stainless steel shroud 171 that provides a channel for the air produced by the blower 172 to thereby improve the heating efficiency of the heating element 170. Further, the blower 172 is configured to draw air from the intake opening 164 in the enclosure 126, through the coils of the heating element 170 and then exhaust the air through an enclosure exhaust opening 166.

Preferably, the intake opening 164 of the enclosure is connected to the outlet tube 130*b* (FIG. 1) whereby air from the space 111 between the cover 112 and the concave surface 110 of the antenna is provided to the heating element 170 and is reheated. Similarly, the exhaust opening 166 in the heater enclosure 126 is connected to the inlet tube 130*a* (FIG. 1) that provides the heated air from the enclosure 126 to the space between the cover 112 and the concave surface 110 of the antenna dish 102.

Hence, in the preferred embodiment, the blower 172 draws air out of the space 111 through the tube 130*b* and then through the heating element 170 to reheat this air. Subsequently, the blower 172 then exhausts this heated air out through the exhaust opening 166 through the tube 130*a* and the tube 134*a* back into the space 111 between the cover 112 and the concave surface 110 of the antenna dish 102. Consequently, a closed loop heating circuit is established whereby heated air is recirculated through the space 111 between the cover and the antenna dish.

Preferably, the blower 172 and the heating element 170 is configured to provide sufficient heated air to the space 111 so that the cover 112 is maintained at a temperature which inhibits wet snow from sticking to the cover 112 and further inhibits formation of ice particles on the cover 112 as a result of freezing rain and freezing fog and inhibit ice and snow build-up on the antenna dish 102. In one embodiment, for a 1.2 meter satellite dish, the heating element is an 800 Watt electrical heating element that is bent in a generally helixical fashion. The heating element is available from Chromolux and is mounted within the enclosure 126 so that the center axis of the heating element is positioned substantially in front of the intake opening 164 so that air is drawn through the center of the helixical heating element. Further, the blower is a 40 to 60 CFM blower that uses a 1/70th horsepower motor to draw the air from the space through the heating element 170 and then back to the space. It will be appreciated that the enclosure 126 also includes the requisite protection and control circuitry used to control and protect the heating element and the motor during operation.

It will further be appreciated that many types of heaters and heating systems and blower and blower systems can be used to provide heat to the space between the cover 112 and the concave surface 110 of the antenna dish 102. For example, for larger antennas it may be desirable to use a gas heating system such as the gas heating system that is currently available from WB Walton Enterprises, Inc. of Riverside, Calif. Further, the exact heat output of the heater and the air transfer capability of the blower is, of course, dependent upon the size of the antenna dish and is also dependent upon the temperatures to which the antenna dish is likely to be exposed. It will further be appreciated that the enclosure 126 can be equipped with a sensing system, such as the sensing systems currently available from WB Walton Enterprises, Inc., that will turn the air and heating system 124 on during particular weather conditions. For example, the sensing system may include a sensor which detects when the air temperature is low enough for snow and ice to form and then automatically activate the air and heating system 124 to provide heated air to the space 111. One preferred embodiment of a sensing system is described in greater detail below in reference to FIGS. 6, 7A and 7B.

Figure 5:
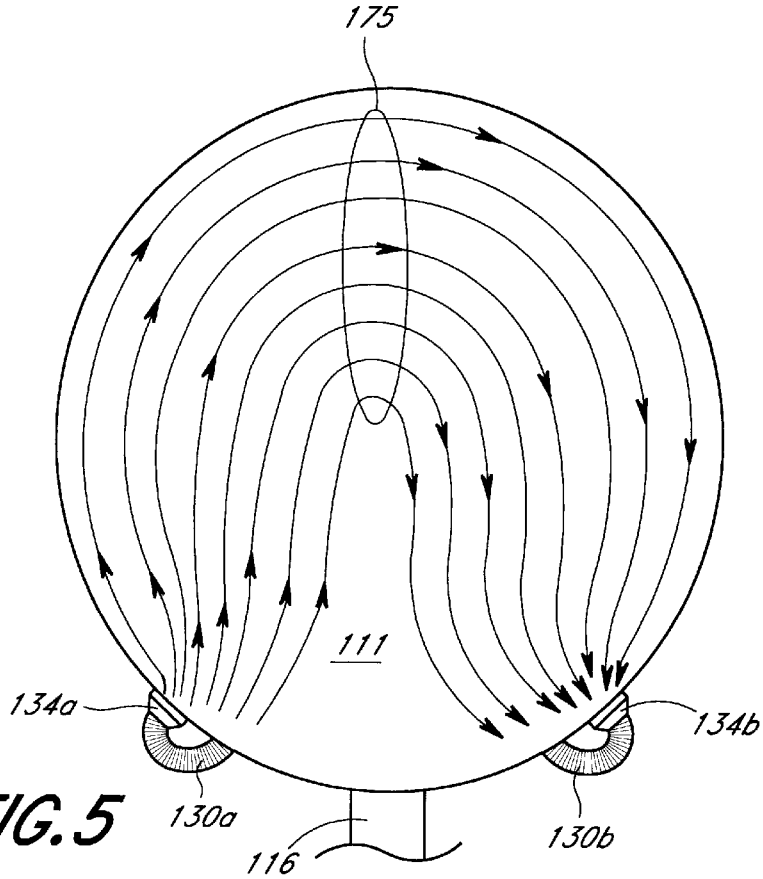
FIG. 5 is a schematic view of the satellite antenna illustrating the airflow in the space between the antenna dish and the cover.

FIG. 5 is a schematic illustration which illustrates how the heated air provided by the heating system 124 is circulated through the space between the cover 112 and the concave surface 110 of the antenna dish 102. Specifically, the vanes 152 on the inlet fixture 134*a* (FIGS. 3A, 3B) in this embodiment induce the heated air to travel around the space 111 in a generally clockwise fashion as illustrated by the arrows 175. In the preferred embodiment, the outlet fitting 134*b* is larger than the inlet fitting 134*a* so that the air flow 175 through the space 111 is not short circuited. For example, in one specific implementation, for an antenna that is 1.2 m in diameter or smaller, the inlet fitting 134*a* has an opening which is 2"×4" and the outlet fitting 134*b* has an opening that is 2"×5". Using a larger return air duct allows the inlet air to be forced to the top of the plenum or space 111 and thereby fully circulate through the space 111. This further contributes to the circulation of the heated air through the space 111 in the clockwise manner shown. It will be appreciated that this circulation of heated air underneath the cover 112 maintains the cover 112 at a temperature which inhibits the formation of snow and ice on the cover and thereby inhibits the interruption of communication signals to and from the satellite dish antenna 100 during inclement weather.

Figure 6:
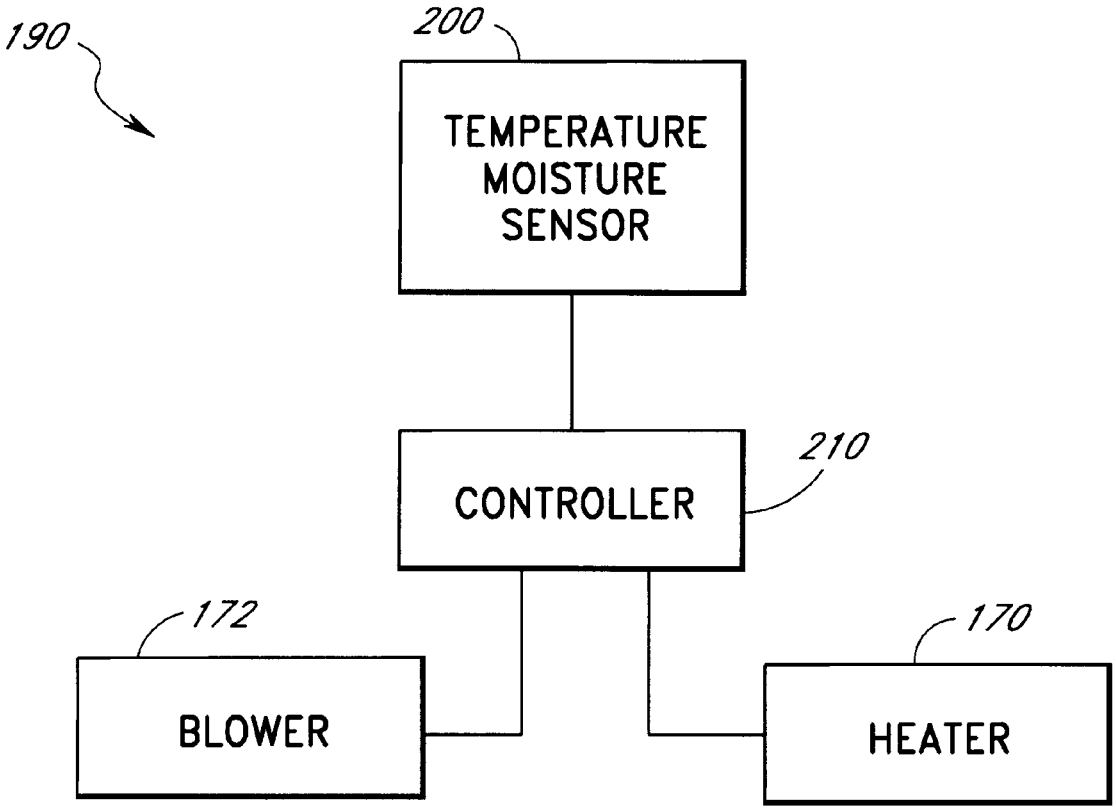
FIG. 6 is an exemplary block diagram showing a layout for a sensor controlled heater and blower system.
Figure 7A:
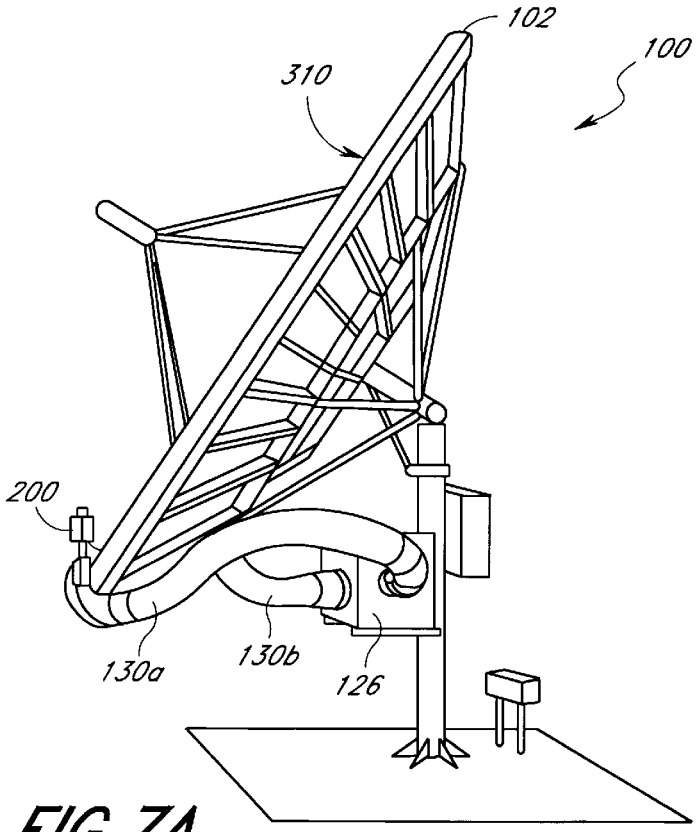
FIG. 7A is a side view of the satellite antenna showing a flat antenna cover occurring in absence of a positive air pressure in the space between the antenna dish and the cover.
Figure 7B:
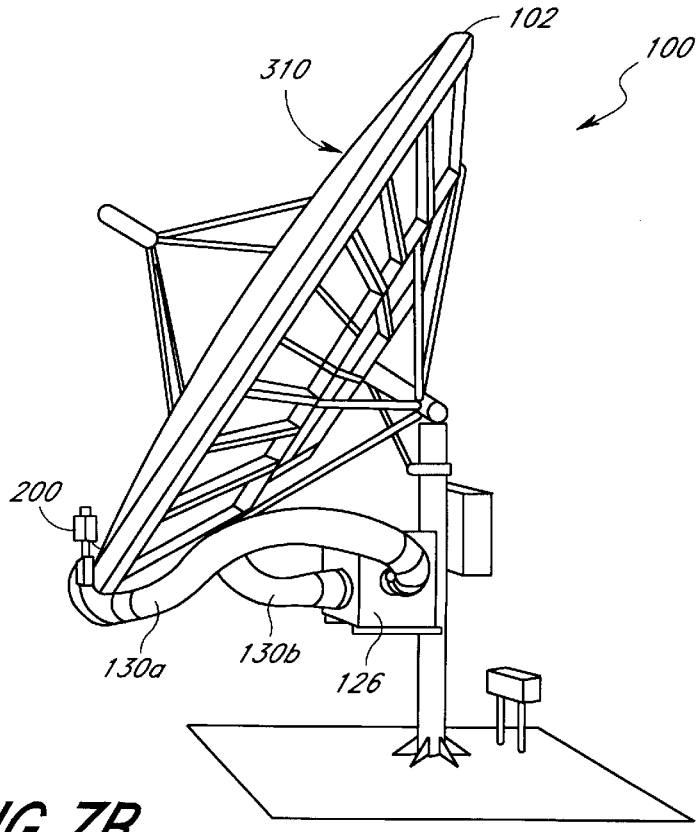
FIG. 7B is a side view of the satellite antenna shown in FIG. 7A, wherein a positive air pressure is applied and the cover is bulged out.

FIGS. 6, 7A and 7B illustrate a control system that can be used with one embodiment of the present invention. Specifically, the heating enclosure 126 is equipped with a temperature/moisture sensor and control unit 190 which turns the heater 170 system on during particular weather conditions. In particular, the sensor and control unit 190 includes a sensor 200, such as a DS-3 moisture/temperature sensor unit available from Automatic System Engineering Inc., of Colorado Springs, Colo. The sensor unit 200 senses both temperature and the presence or absence of moisture and provides signals indicative thereof to a controller 210.

In order to sense atmospheric temperature and moisture conditions, at least one sensor unit 200 is mounted on an edge of the antenna dish 102 ( See FIG. 7A or 7B). Preferably, the sensor 200 is mounted in a location that is removed from the heater enclosure 126 so that the sensor 200 can sense the ambient conditions unaffected by the operation of the heater and blower.

Hence, the sensor unit 200 senses the ambient temperature and moisture conditions, and provides signals to a controller 210 that energizes the heater 170 and blower 172 systems (FIG. 5) in response to the sensed atmospheric conditions. Specifically, the controller 210 selectively turns on the heater 170 and blower 172 systems in response to sensing temperature and humidity within preselected ranges. In this embodiment, the controller 210 turns the blower 172 on when the sensor 200 detects the presence of moisture. In the preferred embodiment, the sensor 200 has a cup that receives moisture and when moisture is present in the cup, the sensor 200 provides a moisture present signal. It will be appreciated by those skilled in the art, that a humidity sensor may also be adapted for use in the system of the preferred embodiment. The controller 210 turns on the heater 170 when the sensor detects the presence of moisture and detects that the temperature is in a temperature range of between 24° F. and 38° F. This is due to a known phenomenon that snow is relatively dry under 24° F., and contrarily is relatively wet over this temperature.

More specifically, in this embodiment, when moisture is present and the ambient temperature is between 24° F. and an upper temperature limit that is selected by the operator in this embodiment, but is preferably around 38° F., the heater 170 and the blower 172 are activated together so that hot air is circulated in the space 111 to de-ice wet snow in the manner described above. Further, the heater 170 and the blower 172 continue to operate as the temperature drops below 24° F., thereby allowing de-icing to continue. However, if moisture is first sensed in the preselected quantity when the temperature is equal or below 24° F., the heater 170 and the blower 172 are not activated by the presence of moisture unless the temperature increases above 24° F. Since snow at this temperature range is very dry, it will not cause any icing problem over the antenna cover.

Finally, when moisture is sensed but the temperature is above the upper limit, the blower 172 is activated to induce a positive air pressure in the space 111. In fact, the blower 172 in larger antennas can activate anytime when moisture is detected in sufficient quantity, regardless of the temperature range. The air entering the space 111 between the dish 110 and cover 112 creates a positive pressure 320 under the cover 112 causing the cover 112 to bulge out as shown in FIG. 7B.

Specifically, FIG. 7A shows a profile of the antenna assembly 100 with no positive pressure under the cover 112 and the cover surface 310 is flat, i.e., flush with the rim of the antenna dish 110. In FIG. 7B, however, the cover surface 310 has a convex shape with respect to the antenna dish 110 due to positive air pressure that has been introduced into the space 111 as a result of the blower 172 operating. This positive air pressure is advantageously used to reduce or prevent moisture from entering the enclosed space 111 between the dish surface and the cover. Additionally, the convex surface aids in the shedding of snow and rain on the outside surface of the cover 112 and thereby accumulations of frozen precipitation on the cover which may degrade the operation of the antenna.

Hence, the control system 190 senses the ambient temperature and presence or absence of moisture of the environment surrounding the antenna. The control system 190 can then selectively activate the blower 172 or the heater 170 or both depending upon the ambient conditions. It will be appreciated that control system 190 of the preferred embodiment is efficient in preventing accumulations of frozen precipitation on the cover of the antenna as it operates the heater 170 only when the temperature is in a range where wet snow, frozen rain or frozen fog could occur. At other temperature ranges, the moisture that is present is either too dry, e.g., the temperature is below 24° F., to stick to the cover or the moisture that is present would not produce frozen precipitation as the temperature is too high e.g., the temperature is above 38° F. In these conditions, only the blower 172 is operated to induce a positive air pressure and prevent accumulations of moisture inside the space 111 between the cover 112 and the antenna 110 and to aid in the shedding of dry snow off of the front surface of the cover.

In one preferred embodiment of the present invention, the satellite antenna 102 is equipped with a cover 112 that is made from a breathable material that allows air to travel through the material but generally prevents water from travelling through the material. The cover in this embodiment is preferably made of a non-laminated Gortex material sold by WL Gore, preferably under the order no. of RA-7941. The material comprising the cover 112 in this embodiment is adapted to allow air to travel from the space 111 to the outer surface of the cover 112 but generally prevent liquid water from travelling through to the space 111.

Figure 8A:
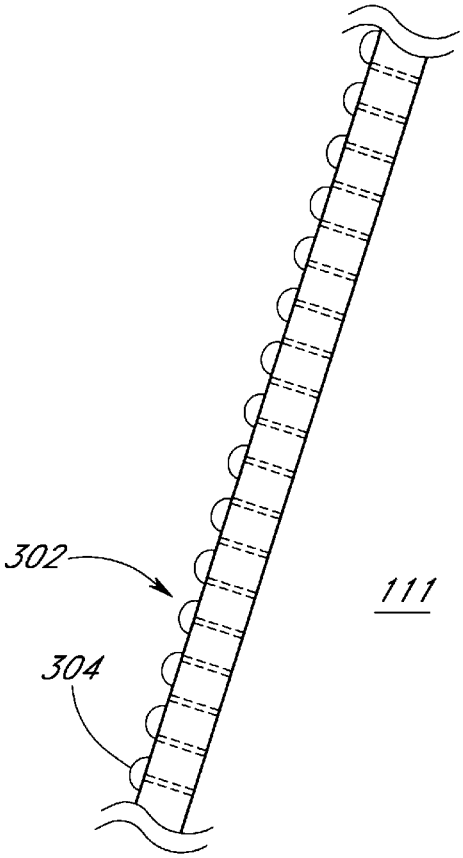
FIG. 8A is a cross-sectional view of a portion of the cover of the preferred embodiment prior to air being circulated in the space between the cover and the front reflecting surface of the antenna.

Using a non-laminated, breathable material for the cover 112 enables the system described above to be adapted to reduce the accumulation of non-frozen moisture, such as rain or moisture resulting from high humidity, on the outer surface of the cover 112. FIG. 8A illustrates that water drops 304 can accumulate on the outer surface 302 of the cover 112 and thereby interfere with communications with the satellite antenna 100.

Figure 8B:
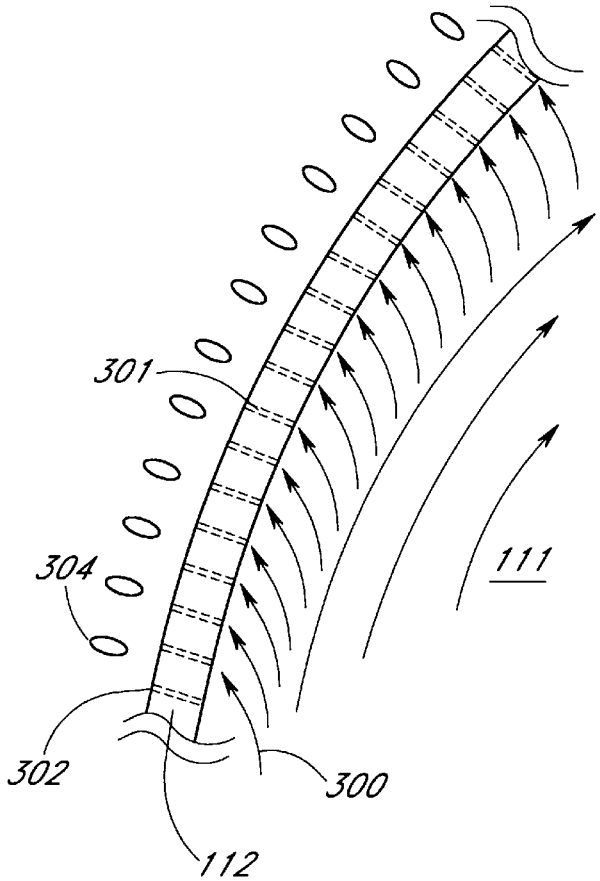
FIG. 8B is a cross-sectional view of the portion of the cover of FIG. 8A, with air circulating in the space between the cover and the front reflecting surface to illustrate that the air travels through the cover and removes water off of the outer surface of the cover.

In one embodiment, the air and heating system 124 discussed above is equipped with a blower that forces air into the space 111 so as to pressurize the air in the space 111 with respect to the surrounding atmosphere. As shown in FIG. 8B, air, represented by the arrows 300 in FIG. 8, can travel through intersticial spaces 101 in the weave of the material comprising the cover 112. When the pressurized air reaches the outer surface 302 of the cover 112, it blows water 304 accumulated on the outer surface 302 of the cover 112 off of the outer surface 302. Hence, being able to blow the accumulated water 304 off of the outer surface 302 of the cover 112 results in the likelihood that water accumulations resulting, for example from either rain or high humidity interfering with satellite communications being reduced. Preferably, the cloth forming the cover 112 is selected so that the intersticial spaces 302 are well-suited for allowing air to travel through the cover but are generally too small to allow liquid water to drain into the space 111.

The control system 190 of FIG. 6 is shown as having a temperature and moisture sensor 200 (See also, FIG. 7A and 7B). The controller 210 can be adapted so that when the moisture sensor 210 or, in an alternate embodiment, a humidity sensor indicates that the environmental conditions are resulting in a significant accumulation of water on the outer surface 302 of the cover 112, the blower 172 can be activated so as to pressurize the air in the space 111 such that the pressurized air travels through the intersticial spaces in the material comprising the cover 112 so as to blow the accumulated water 304 off of the outer surface 302 of the cover 112 in the manner described above. In this fashion, the system 190 can be used to not only prevent the accumulation of snow and ice from adhering to the outer surface 302 of the cover 112, it can also be used to reduce the accumulations of water on the outer surface of the cover 112.

In some locations where satellite antennas are used, the likelihood of snow or ice disrupting communications is remote. This is especially true in more tropical regions where the ambient temperature rarely, if ever, is cold enough to result in the occurrence of snow or freezing conditions. However, in these environments, it is often very humid and rainy. The system 190 can therefore be adapted to include only a moisture sensor 200 or a humidity sensor or some combination of the two, the controller 210 and the blower 172. The satellite antenna 100 is equipped with a cover 112 in the same manner as described above, and the blower 172 is adapted to blow pressurized air into the space 111 so as to induce the air to travel through the breathable cover 112 in the manner described above. Hence, this embodiment of the present invention is particularly adaptable for use in warmer, wetter climates.

It will be appreciated that this embodiment of the present invention is particularly well suited for reducing the likelihood of interruption of satellite communications resulting from the accumulation of water in liquid form on the satellite antenna. This system can either be used in conjunction with the heated systems described above or separately as just a forced air system adapted for use in warmer environments.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. A system for reducing accumulations of moisture on a front reflecting surface of a satellite antenna having an outer lip comprising:

a flexible cover made of a woven material and having an opening which is dimensioned to mount on the outer lip of said antenna with the cover positioned over the front reflecting surface of the satellite antenna so as to define a space between the front reflecting surface of the antenna and the cover whereby the cover reduces accumulations of moisture on the front reflecting surface of the satellite antenna while permitting satellite signals to pass therethrough; and an air supply system which provides air to the space between the cover and the front reflecting surface so as to induce positive pressure in the space with respect to the surrounding atmosphere wherein the cover is adapted to allow pressurized air to travel therethrough so that water accumulated on the outer surface of the cover is removed from the outer surface by the pressurized air travelling through the cover.

2. The system of claim 1, wherein the cover is made of a non-laminated polytetrafluorethylene cloth.

3. The system of claim 1, further comprising:

a sensing system which senses the presence of moisture of the atmosphere surrounding the satellite antenna;

a controller which receives signals form the sensing system wherein the controller activates the air supply system upon the sensing system detecting the presence of a preselected quantity of moisture.

4. The system of claim 1, wherein the flexible cover is adapted to be positioned on an antenna having a 1.2 meter diameter and the air supply system is adapted to provide 40 to 60 CFM of pressurized air into the space defined by the cover and the front reflecting surface of the antenna.

5. The system of claim 1, further comprising a heating system for heating the air provided to the space so as to reduce the accumulations of frozen precipitation on the front surface of the cover.

6. A system for preventing the interruption of satellite communications with an earth based satellite antenna resulting from liquid water accumulating in front of the front reflecting surface of the antenna, the system comprising:

a flexible cover made of a woven material that is adapted to reduce the likelihood of water travelling through the cover while allowing vapor to travel through the cover, the flexible cover defining an opening which is dimensioned to mount on the outer lip of the antenna with the cover positioned over the front reflecting surface of the satellite antenna so as to define a space between the front reflecting surface of the antenna and the cover, wherein the cover reduces accumulations of water on the front reflecting surface of the antenna while permitting satellite signals to pass therethrough; and an air supply system which provides air to the space between the cover and the front reflecting surface so as to induce positive pressure in the space with respect to the surrounding atmosphere so that water accumulated on the outer surface of the cover is removed from the outer surface by the pressurized air travelling through the cover.

7. The system of claim 6, wherein the cover is made of a non-laminated polytetrafluorethylene cloth.

8. The system of claim 6, further comprising:

a sensing system which senses the presence of moisture of the atmosphere surrounding the satellite antenna;

a controller which receives signals form the sensing system wherein the controller activates the air supply system upon the sensing system detecting the presence of a preselected quantity of moisture.

9. The system of claim 6, wherein the flexible cover is adapted to be positioned on an antenna having a 1.2 meter diameter and the air supply system is adapted to provide 40 to 60 CFM of pressurized air into the space defined by the cover and the front reflecting surface of the antenna.

10. The system of claim 6, further comprising a heating system for heating the air provided to the space so as to reduce the accumulations of frozen precipitation on the front surface of the cover.

11. A method of preventing accumulations of liquid moisture from interrupting satellite communications with an earth based antenna, the method comprising the steps of:

positioning a cover made of a woven material on the opening to the antenna so that the cover inhibits moisture in the form of rain or humidity produced moisture from being deposited on the front reflecting surface of the cover, wherein the step of positioning the cover comprises positioning a breathable cover on the antenna so as to define a space between the front reflecting surface of the antenna and an inner surface of the antenna;

circulating air into the space so that the air in the space is at a higher pressure than the surrounding atmosphere, wherein the circulating air step results in air travelling through the breathable cover so that water accumulated on the outer surface of the cover is removed from the outer surface by the air travelling through the cover.

12. The method of claim 11, wherein the step of positioning the cover on the opening comprises positioning a cover made of non-laminated polytetrafluorethylene cloth.

13. The method of claim 11, further comprising the step of sensing the presence of a weather condition that will result in the deposition of liquid water on the outer surface of the cover and initiation the circulating air step in response to the sensing step.

14. The method of claim 11, wherein the positioning a cover step comprises positioning a cover on a 1.2 meter diameter antenna and the step of circulating air comprises circulating the air at a rate of 40 to 60 CFM.

* * * * *